United States Patent [19]

Valentino et al.

[11] 4,268,831

[45] May 19, 1981

[54] ANTENNA FOR SCANNING A LIMITED SPATIAL SECTOR

[75] Inventors: Pasquale A. Valentino, Glen Head; John C. Herper, Glen Cove; John J. Stangel, Mahopac, all of N.Y.

[73] Assignee: Sperry Corporation, New York, N.Y.

[21] Appl. No.: 34,222

[22] Filed: Apr. 30, 1979

[51] Int. Cl.[3] ..... H01Q 19/06

[52] U.S. Cl. ..... 343/754; 343/854; 343/911 L

[58] Field of Search ..... 343/754, 854, 911 R, 343/911 L

[56] References Cited

U.S. PATENT DOCUMENTS

| | | | |
|---|---|---|---|
| 3,170,158 | 2/1965 | Rotman | 343/754 |
| 3,245,081 | 4/1966 | McFarland | 343/754 |
| 3,384,890 | 5/1968 | List et al. | 343/911 R |
| 3,631,503 | 12/1971 | Tang et al. | 343/754 |
| 3,835,469 | 9/1974 | Chen et al. | 343/754 |

OTHER PUBLICATIONS

Tong et al., Wide Angle Limited Scan Array Antenna Technique Study, NTIS AD 780048, May 1974, pp. 1–6.

*Primary Examiner*—Eli Lieberman

*Attorney, Agent, or Firm*—Howard P. Terry; Seymour Levine

[57] ABSTRACT

A feed system for scanning focal plane antenna systems with which a variable focal spot illumination may be achieved within the focal region of a primary antenna over a limited scanning sector is disclosed. An array of collector elements positioned to receive radiation from a scannable feed antenna is coupled to an array of radiator elements positioned in the focal region of the primary antenna, the positioning of the radiator and collector elements are such that the focal spot illumination is caused to vary with the scan angle of the antenna.

6 Claims, 3 Drawing Figures

ANTENNA FOR SCANNING A LIMITED SPATIAL SECTOR

BACKGROUND OF THE INVENTION

1. Field of the Invention

The invention relates to antenna systems and more particularly to scanning antenna systems with the capability of effecting desired gain versus scan characteristics over a prescribed spatial sector.

2. Description of the Prior Art

Prior art antenna systems which provide limited scan low sidelobe characteristics with a minimum number of active elements generally employ focal point systems such as lens or reflector type antennas with feed elements movably positioned in the focal region. This movement has been accomplished physically by traversing a feed element about the focal region to positions corresponding to the desired beams in space, or by placing a multiplicity of feed elements at predetermined locations in the focal region and selectively exciting the feed element or combination of elements through a complex switching network to establish the desired beams in space. Applications exist that require an antenna to scan tailor the scanned beam, that is, to provide narrow, high gain beams in one sector of the spatial volume and broad, lower-gain beams in another sector. Antennas of the prior art provided scan tailoring through selective defocussing by varying the phase and amplitude distribution from that required for a focussed beam or by positioning the feed elements predetermined distances forward of the focal plane.

Prior art feed networks capable of switchably coupling the electromagnetic energy to the feed elements and of exciting these elements to provide the required amplitude and phase distributions are characterized by considerable complexity, relatively high loss, and relatively high cost. It is the purpose of the present invention to provide a relatively simple, inexpensive system for switchably coupling electromagnetic energy to the elements of a focal plane scanning antenna to accomplish a desired limited scan function.

SUMMARY OF THE INVENTION

A preferred antenna focal plane feed system in accordance with the principles of the present invention employs an electronically steerable array of antenna elements, having a minimum number of active controls, to electronically steer a focussed beam of rf energy which illuminates judiciously positioned receiving elements that generate a desired focal spot excitation about a fixed surface. The excitation is then transferred to radiating elements in the antenna's focal region via a distribution network which effects the stretching or contracting of the focal spot excitation, thus enabling a beam of the required gain and beamwidth, to be radiated by the antenna in the desired spatial direction. The feed system may be constructed of reciprocal elements to provide similar transmit and receive characteristics.

DESCRIPTION OF THE PREFERRED EMBODIMENTS

Focal point antennas, such as lenses and reflectors, offer a natural mechanism for controlling the beam width of a scanned antenna beam over a limited spatial scanning sector. In these antennas an area exists in the focal plane which is the focal spot for a corresponding beam in space. The size of this focal spot is inversely proportional to the size of the radiation aperture. Thus, a decrease in the size of the radiating aperture over that of the maximum gain size causes an increase in the size of the focal spot. The excitation of a larger focal spot than that corresponding to the maximum gain radiation aperture results in broader beamwidth, lower gain operation. This property may be utilized to control the gain and beam width of the antenna beam as it is scanned through the scanning sector.

Figure 1:
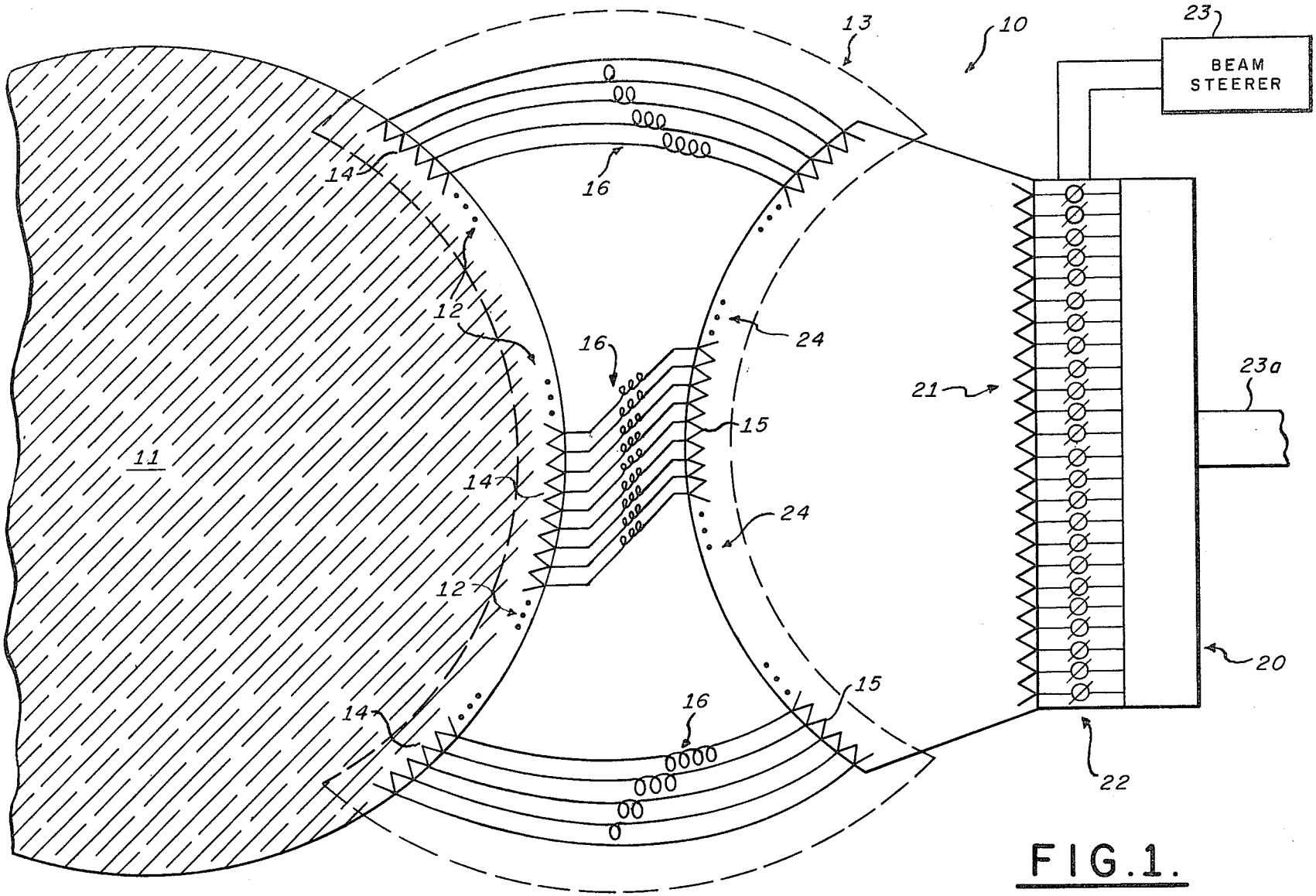
FIG. 1 is a schematic representation of a preferred embodiment of the present invention showing the electronically steerable array, collector elements, distribution network, and radiating focal plane elements.

Referring to FIG. 1, there is shown in cross section, an antenna 10 for scanning a limited spatial sector including a primary antenna 11, which may be of the type generally known as a focal point antenna, possessing minimum variations in focal field properties over a section of its focal region centered about the focal point. This class of antennas includes lenses such as constant-K and Luneberg and reflectors such as, for example, the focal point fed paraboloid. The primary antenna 11 may be a spherical lens shown in cross-section in FIG. 1. It should be understood, however, that the discussion to follow is equally applicable to all devices within the general class of focal point antennas. Electromagnetic signals are coupled to the focal region 12 of the primary antenna 11 through a distribution network 13 which includes radiator elements 14 positioned in the focal region 12, collector elements 15, and interconnecting lines 16 which couple corresponding collector and radiator elements. Electromagnetic energy is received by distribution network 13 from a feed array 20 which includes an array of antenna elements 21, each of which is coupled to a phase shifter in a phase shifter bank 22 which is controlled by a beam steerer 23.

Electromagnetic energy coupled to the feed array 20 via transmission line **23*a* is distributed to the elements of the array 21 via the phase shifters in the phase shifter bank 22. The combination of the array 21, phase shifter bank 22, and beam steerer 23 steerably focuses a beam of electromagnetic energy along a focal region 24 wherein collector elements 15 are positioned in a substantially spherical surface in a predetermined manner. These collector elements 15 are correspondingly coupled via interconnecting lines 16 of substantially equal length to an equal number of radiator elements 14, which are positioned in a predetermined manner along the focal region 12 of the antenna 11. The spacing of the collector elements 15 and the radiator element 14 in the respective focal regions may be controlled to stretch or contract the illuminated spot in the focal region 12 of the antenna 11 relative to the illuminated area in the focal region 24. It will be apparent to those skilled in the art that the feed array elements 21 are not restricted to a planar surface and that they may be positioned on any surface that permits the desired illumination of the focal region 24**.

Figure 2A:
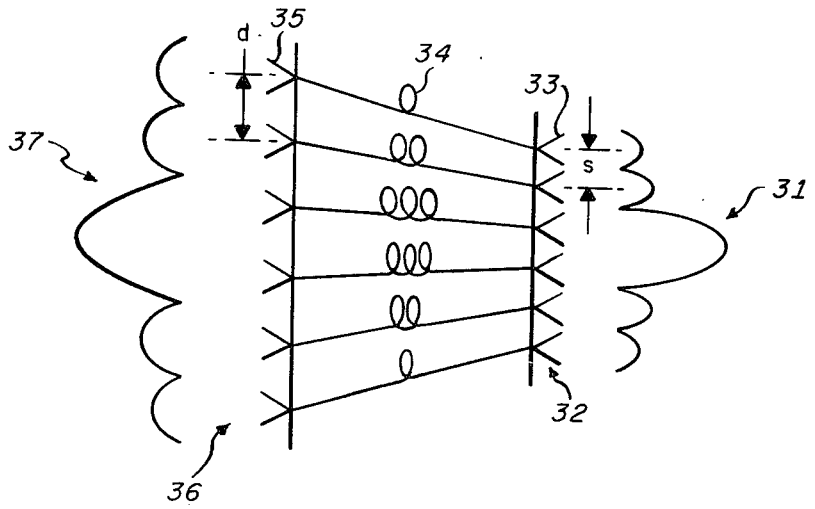
FIGS. 2A and 2B are illustrations of methods for contracting and expanding the excitation area in the focal plane of an antenna.
Figure 2B:
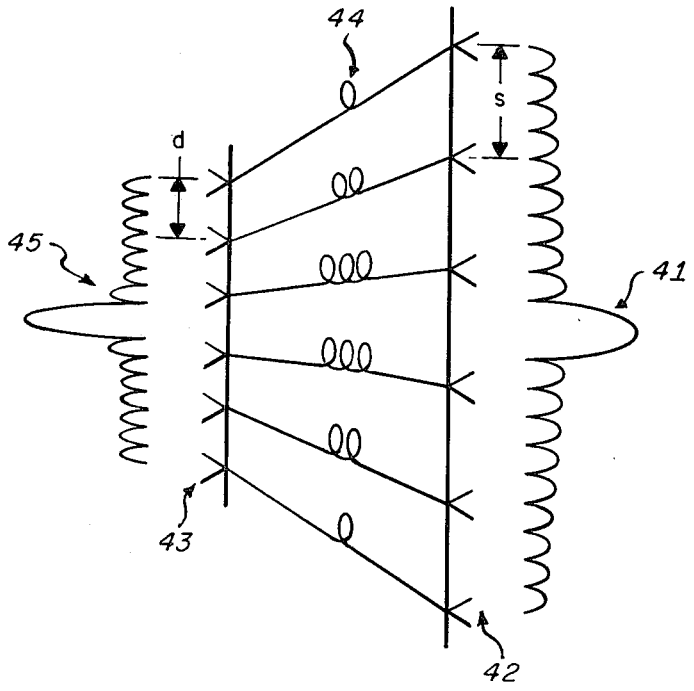

A focal function expansion is illustrated in FIG. 2A. A focal function 31 of the feed array 21 (FIG. 1) is incident to collector elements 32 in the feed array focal region 24. Energy collected by a collector element, as for example, collector element 33, is coupled via a transmission line 34 to its corresponding radiator element 35 of radiator elements 36. When the element spacing of the radiator elements 36 is greater than the element spacing of the collector elements 32, as shown in the figure, a broader focal function 37 results in the focal region of the primary antenna. Now refer to FIG. 2B wherein an arrangement of elements is shown to perform focal function contraction. A focal function 41 is incident to the array of collector elements 42 wherein the element spacings are greater than the spacings between the elements of the array of radiator elements 43. When the energy is coupled from the collector elements 42 via the transmission lines 44 to the radiator elements 43, a contracted focal function 45 results in the focal region of the primary antenna. It should be apparent to those skilled in the art that the focal function incident to the collector elements will be substantially transferred to the focal region of the primary antenna without variation when the spacing "S" between the collector array elements and the spacing "d" between the radiator array elements are substantially equal.

Refer again to FIG. 1. If the distribution network 13 is designed to provide the desired focal spot distribution in the focal region 12 of the antenna 11, permutation of this distribution may be accomplished by scanning the focussed beam formed by the feed array 20 across its focal region 24. The desired focal spot distribution may be realized by positioning the collector elements 15 in the focal region 24 with variable spacings between elements to establish the desired focal spot distribution and positioning the radiator elements 14 uniformly in the focal region 12. It will be recognized that similar focal spot distributions may be obtained in the focal plane 12 by positioning the collector elements 15 with uniform spacing and positioning the radiator elements 14 with the variable spacings to establish the desired focal spot distributions.

The width of the focal spot in the focal region 24 is proportional to the ratio of the length of the array 21 to the radius of the focal region 24. Consequently, the number of substantially non-overlapping focal spots which may be generated in the focal region 24 is directly related to the length of the array 21. Since the spacing between elements of the array 21 is dictated by the total angular scan range of the array 21, the number of phase shifters 22 is also directly related to the number of substantially non-overlapping focal spots. Therefore, selective expansion and contraction of the distribution of electromagnetic field between the focal region 24 and the focal region 12 will permit the desired focal spot distribution in the focal region 12 to be realized with a minimum number of non-overlapping focal spots in the focal region 24 and a concomitant minimum number of phase shifters 22. Since the cost of the phase shifters represents a major factor of the total cost of the antenna system, the cost of the antenna system is therefore reduced due to the minimum number of phase shifters required as a consequence of the invention.

Though substantially equal line lengths for the interconnecting lines 16 have been assumed, it should be apparent to those skilled in the art that this is not a requirement. When the length of the interconnecting lines 16 are not equal, the contour of the surface on which the collector elements 15 are positioned would not be spherical, this contour then depending upon the phase distribution at the collector elements 15 introduced by the variation of the line lengths.

While the invention has been described in its preferred embodiment, it is to be understood that the words which have been used are words of description rather than of limitation and that changes within the purview of the appended claims may be made without departing from the true scope and spirit of the invention it its broader aspects.

We claim:

1. A scanning antenna system comprising:

scanning means for scannably directing electromagnetic radiation through a multiplicity of determinable scan angles to corresponding preselected areas of predetermined dimensions in a first focal region;

a first array of antenna elements positioned in said first focal region with uniform spacing therebetween such that at each of said determinable scan angles a multiplicity of said antenna elements within each of said corresponding preselected areas are in an energy coupling relationship with scanning means;

a second array of antenna elements positioned in a second focal region with non-uniform spacing therebetween, said antenna elements of said second array coupled in one-to-one correspondence to said antenna elements of said first array establishing areas with predetermined variable dimensions in said second focal region corresponding to areas in said first focal region with said non-uniform spacing arranged such that said areas in said second focal region vary as a function of said determinable scan angle, thereby providing a scanned focal region with a scan variable focal region distribution in said second focal region; and antenna means having an antenna aperture and a focal region positioned to be substantially coincident with said second focal region for transforming said scanned focal region with said scan variable distribution to a corresponding distribution in said antenna aperture, thereby providing a scan tailored antenna pattern.

2. A scanning antenna system in accordance with claim 1 wherein said antenna elements of said first array are coupled to said antenna elements of said second array in one-to-one correspondence via transmission lines of substantially equal length, and wherein said antenna elements of said first array are positioned on a first spherical surface having a first radius of curvature as measured from a first center of curvature and said antenna elements of said second array are positioned on a second spherical surface having a second radius of curvature as measured from a second center of curvature.

3. A scanning antenna system comprising:

scanning means for scannably directing electromagnetic radiation through a multiplicity of determinable scan angles to corresponding preselected areas of predetermined dimensions in a first focal region;

a first array of antenna elements positioned in said first focal region with non-uniform spacing therebetween such that at each determinable scan angle a multiplicity of said antenna elements is within said corresponding preselected area and in an energy coupling relationship with said scanning means, said antenna element multiplicity varying as a function of said determinable scan angle;

a second array of antenna elements positioned in a second focal region with uniform spacing therebetween, said antenna elements of said second array coupled in one-to-one correspondence to said antenna elements of said first array establishing areas containing antenna elements in said second focal region corresponding to areas in said first focal region, whereby said areas in said second focal region are caused to vary as a function of said determinable scan angle, thereby providing a scanned focal region with a scan variable focal region distribution in said second focal region; and antenna means having an antenna aperture and a focal region positioned to be substantially coincident with said second focal region for transforming said scanned focal region with said scan variable distribution to a corresponding distribution in said antenna aperture, thereby providing a scan tailored antenna pattern.

4. A scanning antenna system in accordance with claim 3 wherein said antenna elements of said first array are coupled to said antenna elements of said second array in one-to-one correspondence via transmission lines of substantially equal length, and wherein said antenna elements of said first array are positioned on a first spherical surface having a first radius of curvature as measured from a center of a curvature and said antenna elements of said second array are positioned on a second spherical surface having a second radius of curvature as measured from a second center of curvature.

5. A scanning antenna system in accordance with claims 2, 1, 3, or 4 wherein said scanning means is a scannable array of radiating elements positioned on a planar surface.

6. A scanning antenna system in accordance with claims 2, 1, 3, or 4 wherein said scanning means is a scannable array of radiating elements positioned on a non-planar surface.

* * * * *